US011472615B1

(12) United States Patent
Lu

(10) Patent No.: US 11,472,615 B1
(45) Date of Patent: Oct. 18, 2022

(54) AIRTIGHT CONTAINER WITH AN EASILY DETACHABLE COVER

(71) Applicant: Ningbo Halson Import & Export Co., Ltd., Ningbo (CN)

(72) Inventor: Jiehua Lu, Ningbo (CN)

(73) Assignee: Ningbo Halson Import & Export Co., Ltd., Ningbo (CN)

( * ) Notice: Subject to any disclaimer, the term of this patent is extended or adjusted under 35 U.S.C. 154(b) by 0 days.

(21) Appl. No.: 17/560,289

(22) Filed: Dec. 23, 2021

(30) Foreign Application Priority Data

Dec. 3, 2021 (CN) ..... 202123029635.9

(51) Int. Cl.

| | |
|---|---|
| ***B65D 53/02*** | (2006.01) |
| ***B65D 25/28*** | (2006.01) |
| ***B65D 43/06*** | (2006.01) |
| ***B65D 25/32*** | (2006.01) |

(52) U.S. Cl.
CPC ..... *B65D 53/02* (2013.01); *B65D 25/2858* (2013.01); *B65D 43/06* (2013.01); *B65D 25/2835* (2013.01); *B65D 25/32* (2013.01); *B65D 2525/285* (2013.01); *B65D 2525/286* (2013.01); *B65D 2525/287* (2013.01); *B65D 2525/288* (2013.01); *B65D 2543/00972* (2013.01)

(58) Field of Classification Search
CPC ..... B65D 25/2858; B65D 25/2835; B65D 25/32; B65D 53/02; B65D 2543/00972; B65D 51/242; B65D 2525/285; B65D 2525/286; B65D 2525/287; B65D 2525/288
See application file for complete search history.

(56) References Cited

U.S. PATENT DOCUMENTS

| | | | | |
|---|---|---|---|---|
| 9,382,050 | B2 | 7/2016 | Lee | |
| 9,850,047 | B2 | 12/2017 | Wang | |
| 10,633,157 | B2 | 4/2020 | Lee | |
| 10,737,847 | B1 * | 8/2020 | Liu | B65D 43/06 |
| 11,027,900 | B2 * | 6/2021 | Liu | B65D 45/327 |
| 2012/0031902 | A1 * | 2/2012 | Gilbert | B65D 39/08 220/212.5 |
| 2017/0190479 | A1 * | 7/2017 | Liu | B65D 53/02 |
| 2021/0171244 | A1 * | 6/2021 | Tan | A47J 41/0072 |

* cited by examiner

*Primary Examiner* — Don M Anderson
*Assistant Examiner* — Jennifer Castriotta
(74) *Attorney, Agent, or Firm* — True Shepherd LLC; Andrew C. Cheng

(57) ABSTRACT

An easily detachable airtight container includes a container body, a first upper cover, a second upper cover and a handle. The second upper cover is disposed between the container body and the first upper cover. The first upper cover has an opening, while the second upper cover has a convex block which passes through the opening. The handle includes a body. The body has a first coupling portion, while the convex block has a second coupling portion. The first coupling portion and the second coupling portion may are detachably connected. When the first coupling portion is coupled with the second coupling portion, the first upper cover is sandwiched between the second upper cover and the handle. In the present disclosure, the handle forms a detachable connection with the convex block by means of the coupling portions.

17 Claims, 3 Drawing Sheets

AIRTIGHT CONTAINER WITH AN EASILY DETACHABLE COVER

CROSS-REFERENCE TO RELATED APPLICATIONS

This application claims priority to Chinese Patent Application No. 202123029635.9 with a filing date of Dec. 3, 2021. The content of the aforementioned application, including any intervening amendments thereto, is incorporated herein by reference.

TECHNICAL FIELD

The present disclosure relates to the field of airtight containers, and in particular, to an easily detachable airtight container.

BACKGROUND

Airtight containers are common daily necessities in life, which can be used to store foods such as jam and pickles. An airtight container can effectively isolate food stored therein from the outside air through a sealed connection between a container body and a sealing cover thereof, thereby achieving the purposes of moisture protection, insect prevention and anti-oxidation and realizing food preservation for a long time. An existing airtight container has an integrally formed cover, which is inconvenient for cleaning. As a result, the unclean cover of the airtight container will cause secondary pollution to the food stored in the airtight container.

In view of this, an urgent problem to be solved in this technical field is to overcome the shortcomings of the products in the prior art.

SUMMARY

The main technical problem to be solved in the present disclosure is to provide an easily detachable airtight container, in which a handle forms a detachable connection with a convex block by means of coupling portions such that the first upper cover, the second upper cover and the handle can be separated for cleaning.

To solve the above technical problem, one of the technical solutions of the present disclosure is as follows: there is provided an easily detachable airtight container, including a container body, a first upper cover, a second upper cover and a handle; the second upper cover is disposed between the container body and the first upper cover; the first upper cover has an opening, while the second upper cover has a convex block which passes through the opening;

the handle includes a body; the body has a first coupling portion, while the convex block has a second coupling portion, and the first coupling portion and the second coupling portion are detachably connected; and when the first coupling portion is coupled with the second coupling portion, the first upper cover is sandwiched between the second upper cover and the handle.

Preferably, the first coupling portion is rotatably connected to the second coupling portion, and the handle is capable of rotating relative to the second coupling portion.

Preferably, the first coupling portion is a post, while the second coupling portion is a hole.

Preferably, the first coupling portion is a hole, while the second coupling portion is a post.

Preferably, the second coupling portion is disposed on each of opposite first side and second side of the convex block, and the first coupling portion is disposed on each of two opposite ends of the body.

Preferably, a sliding groove is formed on each of the first side and the second side, such that the first coupling portion slides into the second coupling portion through the sliding groove.

Preferably, the first coupling portion is a post, while the second coupling portion is a hole, and the hole is formed at a tail end of the sliding groove.

Preferably, the sliding groove located at the first side is communicated with the sliding groove located at the second side, thus resulting in a U-shaped sliding groove.

Preferably, a depth of the hole is greater than that of the sliding groove.

Preferably, the sliding groove gradually becomes deeper toward the hole.

Preferably, posts located at the two ends of the body are disposed coaxially, and the posts are parallel to a cross member of the body.

Preferably, the handle is made of an elastic material, and a distance between the posts at the two ends of the body is capable of changing under the action of an external force.

When the handle is in a free state, the distance between the posts at the two ends of the body is smaller than that between groove bottoms on two sides at two ends of the sliding grooves corresponding to the body; and when the handle is deformed under the action of an external force, the distance between the posts at the two ends of the body becomes larger than that between the groove bottoms on two sides at the two ends of the sliding grooves corresponding to the body.

Preferably, the handle is U-shaped.

Preferably, an accommodating region is defined on the first upper cover; and the accommodating region is defined around the opening to accommodate the handle.

Preferably, a notch is formed on a side, facing the cross member of the body, of the accommodating region; and a cross section of the notch is cambered.

Preferably, the opening is in a regular quadrangle shape, and a cross section of the convex block is also in a regular quadrangle shape.

Preferably, the airtight container further includes a sealing member which is disposed around the bottom of the second upper cover.

Preferably, a groove is formed in the bottom of the second upper cover, and the sealing member is engaged with the groove.

Preferably, a stop block is disposed on a side of the convex block to limit a position of the convex block relative to the opening.

Preferably, one stop block is disposed on each of four sides of the convex block, and the stop block is located in a middle of a corresponding side.

The present disclosure has the following beneficial effects: the present disclosure provides an easily detachable airtight container, including a container body, a first upper cover, a second upper cover and a handle. The second upper cover is disposed between the container body and the first upper cover. The first upper cover has an opening, while the second upper cover has a convex block which passes through the opening. The handle includes a body. The body has a first coupling portion, while the convex block has a second coupling portion. The first coupling portion and the second coupling portion may are detachably connected. When the first coupling portion is coupled with the second coupling portion, the first upper cover is sandwiched between the second upper cover and the handle. In the present disclosure, the handle forms a detachable connection with the convex block by means of the coupling portions. When the handle is coupled with the convex block, the body of the handle is fixed to the second upper cover, such that the first upper cover is sandwiched between the second upper cover and the handle. When the handle is decoupled from the convex block, the fixation relationship of the first upper cover and the second upper cover can be ended such that the first upper cover, the second upper cover and the handle can be separated for cleaning.

BRIEF DESCRIPTION OF THE DRAWINGS

To explain the technical solutions in embodiments of the present disclosure more clearly, the accompanying drawings required in the embodiments will be described below in brief. Apparently, the accompanying drawings in the following description show merely some embodiments of the present disclosure, and other drawings may be derived from these accompanying drawings by a person of ordinary skill in the art without creative efforts.

LIST OF REFERENCE NUMERALS

Figure 1:
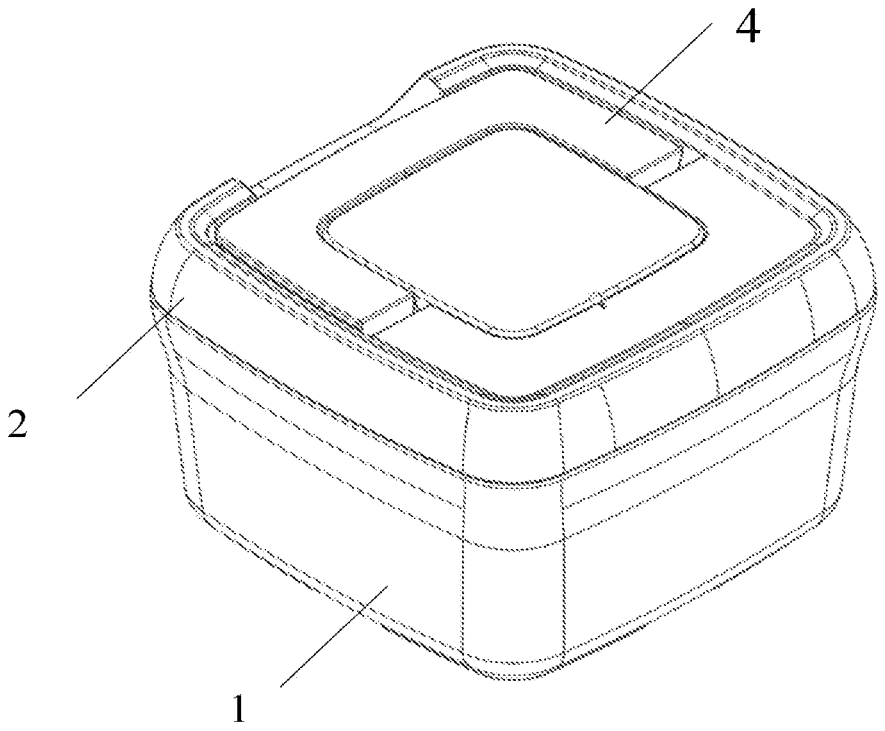
FIG. 1 is a structure diagram of an easily detachable airtight container according to an embodiment of the present disclosure.
Figure 2:
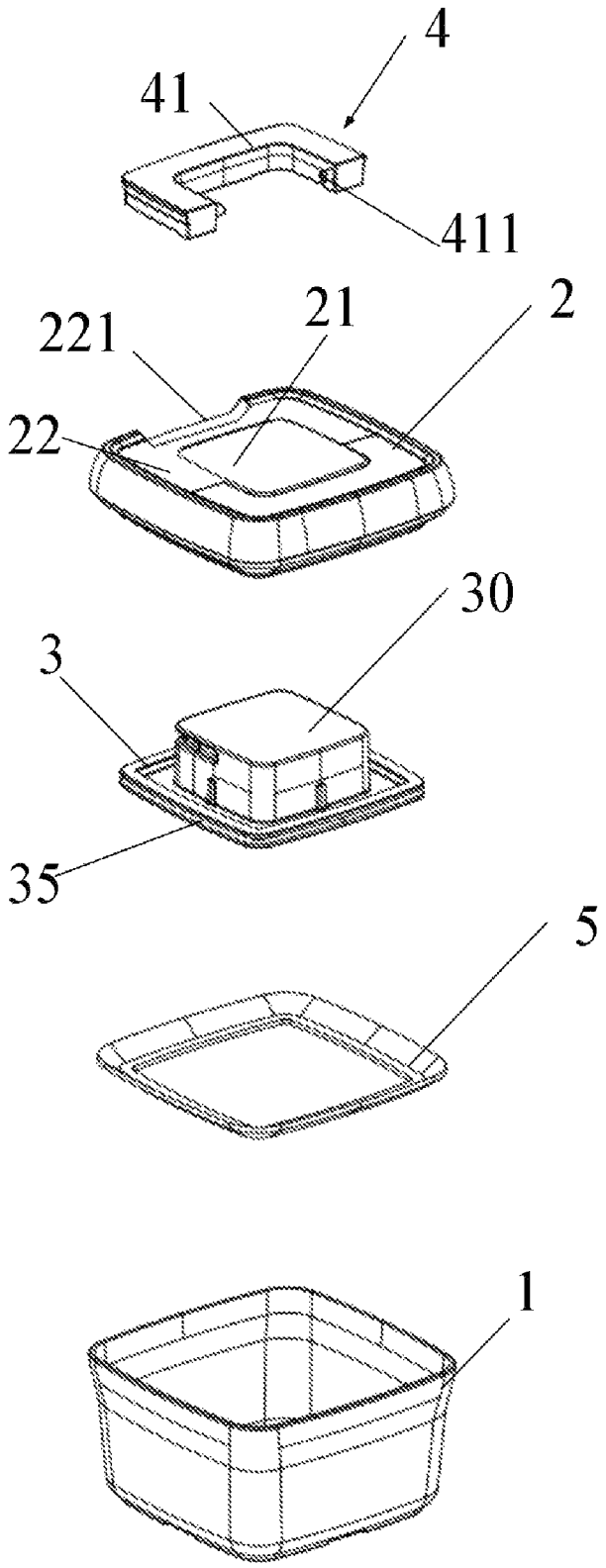
FIG. 2 is an exploded structure diagram of an easily detachable airtight container according to another embodiment of the present disclosure.

1—Container body, 2—first upper cover, 21—opening, 22—accommodating region, 221—notch, 3—second upper cover, 30—convex block, 31—first side, 32—second side, 301—second coupling portion, 33—sliding groove, 34—stop block, 35—groove, 4—handle, 411—first coupling portion, 5—sealing member.

DETAILED DESCRIPTION OF THE EMBODIMENTS

The technical solutions in the embodiments of the present disclosure are clearly and completely described below with reference to the accompanying drawings in the embodiments of the present disclosure. Apparently, the described embodiments are merely some rather than all of the embodiments of the present disclosure. All other embodiments derived from the embodiments of the present disclosure by a person of ordinary skill in the art without creative efforts should fall within the protection scope of the present disclosure.

In the description of the present disclosure, it should be understood that the terms "central", "longitudinal", "transverse", "length", "width", "thickness", "upper", "lower", "front", "rear", "left", "right", "vertical", "horizontal", "top", "bottom", "inner", "outer", and the like are used to indicate orientations or position relationships shown in the accompanying drawings, and these terms are merely intended to facilitate the description of the present disclosure or simplify the description, rather than to indicate or imply that the mentioned apparatus or elements must have the specific orientation or be constructed and operated in the specific orientation. Therefore, these terms cannot be construed as a limitation to the present disclosure. Moreover, the terms "first" and "second" are used only for the purpose of description and should not be construed as indicating or implying a relative importance, or implicitly indicating the number of technical features indicated. Thus, features defined with "first" and "second" may explicitly or implicitly include one or more of the features. In the description of the present disclosure, "a plurality of" means two or more, unless otherwise specifically defined.

In the present disclosure, the word "exemplary" means "serving as an example, instance or illustration". Any embodiment described herein as "exemplary" should not be construed as being more preferred or advantageous over other embodiments. The following description is provided to enable any person skilled in the art to implement and use the present disclosure. In the following description, details are listed for the purpose of explanation. It will be understood that those of ordinary skill in the art can recognize that the present disclosure may be implemented without these specific details. In other examples, well-known structures or processes will not be set forth in detail to avoid that unnecessary details make the present disclosure hard to understand. Therefore, the present disclosure is not intended to be limited to the embodiments illustrated and shall accord with the widest scope consistent with the principles and features disclosed in the present disclosure.

It should be noted that since the methods in the embodiments of the present disclosure are executed in electronic devices, the processing objects for different electronic devices are present in the form of data or information, such as time, which is essentially time information. It can be understood that if size, quantity, position and the like are mentioned in subsequent embodiments, all of them are present as corresponding data for the convenience of processing by the electronic devices, which will not be redundantly in detail here.

The present disclosure provides an easily detachable airtight container. The airtight container includes a container body 1, a first upper cover 2, a second upper cover and a handle 4. The second upper cover 3 is disposed between the container body 1 and the first upper cover 2. The first upper cover 2 has an opening 21, while the second upper cover 3 has a convex block 30 which passes through the opening 21. The handle 4 includes a body 41. The body 41 has a first coupling portion 411, while the convex block 30 has a second coupling portion 301. The first coupling portion 411 and the second coupling portion 301 may be detachably connected. When the first coupling portion 411 is coupled with the second coupling portion 301, the first upper cover 2 is sandwiched between the second upper cover 3 and the handle 4. Specifically, the second upper cover 3 includes the convex block 30 and a cover body surrounding the convex block 30. The shape of the opening 21 matches that of the convex block 30. The opening 21 may have an opening width slightly greater than the maximum width of the convex block 30 and less than the sum of the maximum width of the convex block 30 and the width of two bodies 41. Thus, the first upper cover 2 can be sandwiched between the handle 4 and the cover body of the second upper cover 3.

The peripheral side surface of the body 41 is sunken inward, which is convenient for a user to pick up the handle.

At least one end portion (where the first coupling portion 411 is formed) of the body 41 has a cross-sectional area larger than that of other portion of the body, thus resulting in a gap between the other portion of the body 41 and a groove bottom. Thus, a smaller force is required for a user to pick up the handle.

The first coupling portion 411 is located on a side surface of the body 41 and at a position close to the top. When coupling the first coupling portion 411 with the second coupling portion 301, the first coupling portion 411 exerts an upward force on the convex block 30, thus guaranteeing that the first upper cover 2 and the second upper cover 3 can closely fit together and improving the sealing performance of the airtight container.

Preferably, to reduce the weight, the convex block 30 and the body 41 both have a hollow structure and are thin-walled parts. One of the first coupling portion 411 and the second coupling portion 301 may be a post, while the other one is a hole. When the second coupling portion 301 is a hole, to improve the sealing performance of the airtight container, the second coupling portion 301 is designed as a hollow enclosed cavity. The enclosed cavity has no any gap, and the enclosed cavity forms a seamless connection with a surface of the convex block 30. Specifically, the convex block 30 and the second coupling portion 301 are integrally formed.

In an alternative embodiment, the first coupling portion 411 is a post, and the handle 4 is made of an elastic material. When the handle 4 is in a free state, a distance between the posts at two ends of the body is smaller than that between groove bottoms on two sides at two ends of sliding grooves corresponding to the body. When the handle is deformed under the action of an external force, the distance between the posts at two ends of the body will be larger than that between the groove bottoms on two sides at the two ends of the sliding grooves corresponding to the body 41.

In the present disclosure, the handle forms a detachable connection with the convex block by means of the coupling portions. When the handle is coupled with the convex block, the body 41 of the handle abuts against the second upper cover, such that the first upper cover and the second upper cover are fixed relative to each other. When the handle is decoupled from the convex block, the fixation relationship of the first upper cover and the second upper cover can be ended such that the first upper cover, the second upper cover and the handle can be separated for cleaning.

The opening 21 matches the convex block 30 in shape and size. The opening 21 is in a regular quadrangle shape, and the cross section of the convex block 30 is also in a regular quadrangle shape. For example, the opening 21 is square, and the cross section of the convex block 30 is also square. Alternatively, the opening 21 is rectangular, and the cross section of the convex block 30 is also rectangular.

The handle 4 is U-shaped.

In this embodiment, the airtight container further includes a sealing member 5. The sealing member 5 is disposed around the bottom of the second upper cover 3. The sealing member 5 is in tight fit with the container body 1 to ensure the sealing performance of the airtight container. Specifically, a groove 35 is formed in the bottom of the second upper cover 3, and the sealing member 5 is engaged with the groove 35.

In the present disclosure, the handle 4 forms a detachable connection with the convex block 30 by means of the coupling portions. When the handle 4 is coupled with the convex block 30, the body 41 of the handle 4 abuts against the second upper cover 3, such that the first upper cover 2 and the second upper cover 3 are fixed relative to each other. When the handle 4 is decoupled from the convex block 30, the fixation relationship of the first upper cover 2 and the second upper cover 3 can be ended such that the first upper cover 2, the second upper cover 3 and the handle 4 can be separated for cleaning.

In an actual application scenario, the first coupling portion 411 is rotatably connected to the second coupling portion 301, and the handle 4 is capable of rotating relative to the second coupling portion 301. In an initial state, the handle 4 is flush with the first upper cover 2. To hold the airtight container, a user may turn the handle 4 90 degrees and grasp the handle 4 to hold the airtight container with improved convenience.

In an alternative embodiment, the first coupling portion 411 is a post, and the second coupling portion 301 is a hole. The post is rotatably connected to the hole, i.e., the post is capable of rotating relative to the hole. In another alternative embodiment, the first coupling portion 411 is a hole, and the second coupling portion 301 is a post. The hole is rotatably connected to the post, i.e., the hole can be turned relative to the post.

In a preferred embodiment, the first coupling portion 411 is a post, and the second coupling portion 301 is a hole formed at an end of a sliding groove 33. The sliding groove 33 located at a first side 31 is communicated with the sliding groove 33 located at a second side 32, thus resulting in a U-shaped sliding groove.

To guarantee that the post is able to rotate stably in the hole, the depth of the hole is greater than that of the sliding groove to prevent the post from moving out of the hole. In addition, posts located at two ends of the body 41 are disposed coaxially. The posts are parallel to a cross member of the body 41 to ensure that the handle can be parallel to the body during the rotation.

To facilitate the sliding of the post into the hole, in a preferred embodiment, the sliding groove 33 gradually becomes deeper toward the hole until the sliding groove is communicated with the hole.

In an actual application scenario, the handle 4 is made of an elastic material, and the distance between the posts at the two ends of the body 41 may change under the action of an external force.

In this embodiment, an accommodating region 22 is defined on the first upper cover 2. The accommodating region 22 is defined around the opening 21 to accommodate the handle 4. A notch 221 is formed on a side, facing the cross member of the body, of the accommodating region 22. The cross section of the notch 221 is cambered, and the handle 4 can be picked up through the notch.

In this embodiment, the second coupling portion 301 is disposed on each of the opposite first side 31 and second side 32 of the convex block 30, and the first coupling portion 411 is disposed on each of two opposite ends of the body 41. Furthermore, the sliding groove 33 is formed on each of the first side 31 and the second side 32, and the second coupling portions 301 are disposed at the tail ends of the sliding grooves 33, thereby facilitating the sliding of the first coupling portions 411 into the second coupling portions 301 through the sliding grooves 33. In a preferred embodiment, the first coupling portion 411 is a post, while the second coupling portion 301 is a hole.

Figure 3:
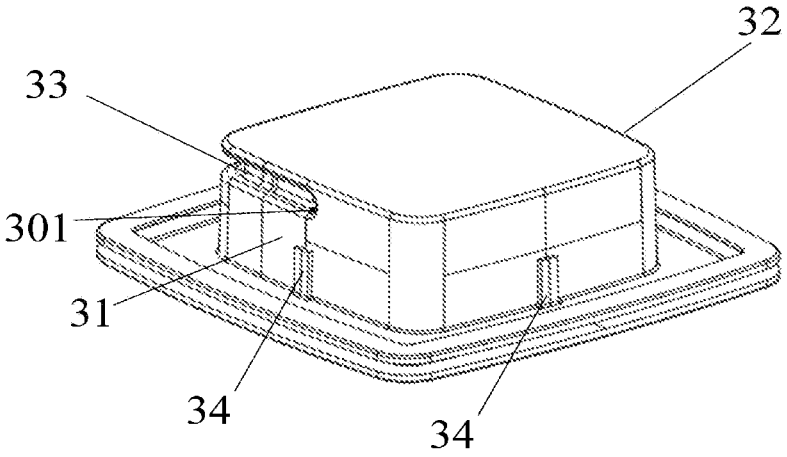
FIG. 3 is a structure diagram of a second upper cover according to an embodiment of the present disclosure.

In a preferred embodiment, as shown in FIG. 3, stop blocks 34 are disposed on the left and right sides (the first side 31 and the second side 32) and the front and rear sides of the convex block 30 to limit the position of the convex block 30 relative to the opening 21. Stop plates (not shown) are correspondingly disposed on inner sides of the first upper cover 2. When an external force is applied to the second upper cover 3, the convex block 30 on the second upper cover 3 slides into the opening 21 until the stop blocks 34 abut against the stop plates, thereby guaranteeing that the central axis of the second coupling portion 301 is flush with a specified reference plane. The specified reference plane is the plane of the axis of the second coupling portion 301 when the handle 4 is placed on the first upper cover 2.

In this embodiment, one stop block 34 is disposed on each of the four sides of the convex block 30. The stop block 34 is located in a middle of a corresponding side to guarantee the stability of the second upper cover 3 under stress.

In an actual application scenario, the handle 4 is made of a plastic material with certain elasticity, and the distance between the first coupling portions 411 at the two ends of the body 41 may change under the action of an external force.

In this embodiment, when the first coupling portion 411 is a post and the second coupling portion 301 is a hole, an outward force is applied to the body 41 to increase the distance between the two posts, thereby allowing the two posts to slide into the holes. The body 41 is then pushed backward until the two posts get into the two holes, respectively. Thus, the installation of the first upper cover 2, the second upper cover 3 and the handle 4 is completed. To detach the first upper cover 2, the second upper cover 3 and the handle 4, an outward force is applied to the body 41 to increase the distance between the two posts, and the two posts are disengaged from the holes. The body 41 is then pulled forward until the posts get out of the sliding grooves 33. Thus, the detachment of the first upper cover 2, the second upper cover 3 and the handle 4 is completed.

In the present disclosure, the handle 4 forms a detachable connection with the convex block 30 by means of the coupling portions. When the handle 4 is coupled with the convex block 30, the body 41 of the handle 4 abuts against the second upper cover 3, such that the first upper cover 2 and the second upper cover 3 are fixed relative to each other. When the handle 4 is decoupled from the convex block 30, the fixation relationship of the first upper cover 2 and the second upper cover 3 can be ended such that the first upper cover 2, the second upper cover 3 and the handle 4 can be separated for cleaning.

The above described are merely implementations of the present application, which do not constitute a limitation on the scope of the present patent application. Any equivalent structure or equivalent process change made based on the description and drawings of the present application, or direct or indirect application thereof in other related technical fields, should still fall in the protection scope of the patent of the present application.

What is claimed is:

1. An easily detachable airtight container, comprising a container body, a first upper cover, a second upper cover and a handle, wherein the second upper cover is disposed between the container body and the first upper cover; the first upper cover has an opening, while the second upper cover has a convex block which passes through the opening;

the handle comprises a body; the body has a first coupling portion, while the convex block has a second coupling portion, and the first coupling portion and the second coupling portion are detachably connected;

when the first coupling portion is coupled with the second coupling portion, the first upper cover is sandwiched between the second upper cover and the handle;

the second coupling portion is disposed on each of a first side and an opposite second side of the convex block, and the first coupling portion is disposed on each of two opposite ends of the body;

a sliding groove is formed on each of the first side and the second side, such that the first coupling portion slides into the second coupling portion through the sliding groove; and the sliding groove located at the first side is communicated with the sliding groove located at the second side, thus resulting in a U-shaped sliding groove.

2. The airtight container according to claim 1, wherein the first coupling portion is rotatably connected to the second coupling portion, and the handle is capable of rotating relative to the second coupling portion.

3. The airtight container according to claim 2, wherein the first coupling portion is a post, while the second coupling portion is a hole having an enclosed cavity; and the second coupling portion and the convex block are integrally formed.

4. The airtight container according to claim 2, wherein at least one end portion of the body has a cross-sectional area larger than that of another portion of the body.

5. The airtight container according to claim 1, wherein the first coupling portion is a post, while the second coupling portion is a hole, and the hole is formed at a tail end of the sliding groove.

6. The airtight container according to claim 5, wherein a depth of the hole is greater than that of the sliding groove.

7. The airtight container according to claim 5, wherein posts located at the two ends of the body are disposed coaxially, and the posts are parallel to a cross member of the body.

8. The airtight container according to claim 5, wherein the handle is made of an elastic material, and a distance between posts at the two ends of the body is capable of changing under action of an external force;

when the handle is in a free state, the distance between the posts at the two ends of the body is smaller than that between groove bottoms on two sides at two ends of the sliding grooves corresponding to the body; and when the handle is deformed under the action of an external force, the distance between the posts at the two ends of the body becomes larger than that between the groove bottoms on two sides at the two ends of the sliding grooves corresponding to the body.

9. The airtight container according to claim 1, wherein a peripheral side surface of the body is sunken inward.

10. The airtight container according to claim 1, wherein an accommodating region is defined on the first upper cover; and the accommodating region is defined around the opening to accommodate the handle.

11. The airtight container according to claim 10, wherein a notch is formed on a side, facing a cross member of the body, of the accommodating region; and a cross section of the notch is cambered.

12. The airtight container according to claim 1, wherein the opening is in a regular quadrangle shape, and a cross section of the convex block is also in a regular quadrangle shape.

13. The airtight container according to claim 1, further comprising a sealing member which is disposed around a bottom of the second upper cover.

14. The airtight container according to claim 13, wherein a groove is formed in the bottom of the second upper cover, and the sealing member is engaged with the groove.

15. The airtight container according to claim 1, wherein a stop block is disposed on a side of the convex block to limit a position of the convex block relative to the opening.

16. An airtight container, comprising a container body, a first upper cover, a second upper cover and a handle, wherein the second upper cover is disposed between the container body and the first upper cover; the first upper cover has an opening, while the second upper cover has a convex block which passes through the opening;

the handle comprises a body; the body has a first coupling portion, while the convex block has a second coupling portion, and the first coupling portion and the second coupling portion are detachably connected;

when the first coupling portion is coupled with the second coupling portion, the first upper cover is sandwiched between the second upper cover and the handle;

the second coupling portion is disposed on each of a first side and an opposite second side of the convex block, and the first coupling portion is disposed on each of two opposite ends of the body;

a sliding groove is formed on each of the first side and the second side, such that the first coupling portion slides into the second coupling portion through the sliding groove;

the first coupling portion is a post, while the second coupling portion is a hole, and the hole is formed at a tail end of the sliding groove; and the sliding groove gradually becomes deeper toward the hole.

17. An airtight container, comprising a container body, a first upper cover, a second upper cover and a handle, wherein the second upper cover is disposed between the container body and the first upper cover; the first upper cover has an opening, while the second upper cover has a convex block which passes through the opening;

the handle comprises a body; the body has a first coupling portion, while the convex block has a second coupling portion, and the first coupling portion and the second coupling portion are detachably connected;

when the first coupling portion is coupled with the second coupling portion, the first upper cover is sandwiched between the second upper cover and the handle;

wherein one stop block is disposed on each of four sides of the convex block to limit a position of the convex block relative to the opening, and the stop block is located in a middle of a corresponding side.

* * * * *